US005387262A

United States Patent [19]

Nelson

[11] Patent Number: 5,387,262

[45] Date of Patent: Feb. 7, 1995

[54] PROCESS FOR INCREASING THE LIGHTFASTNESS OF DYED FABRICS

[75] Inventor: Larry W. Nelson, Pinnacle, N.C.

[73] Assignee: Surry Chemicals, Mt. Airy, N.C.

[21] Appl. No.: 951,453

[22] Filed: Sep. 25, 1992

[51] Int. Cl.[6] ..... D06P 5/02; D06P 5/04

[52] U.S. Cl. ..... 8/442; 8/115.56; 8/583; 8/609; 252/8.6; 252/8.9

[58] Field of Search ..... 8/582, 583, 607, 922, 8/490, 492, 442, 930, 580, 582, 583, 442, 609; 252/305, 312, 8.6, 8.9; 424/59, 60, 63, 64, 70

[56] References Cited

U.S. PATENT DOCUMENTS

| | | | |
|---|---|---|---|
| 4,229,172 | 10/1980 | Baumann et al. | 8/533 |
| 4,322,544 | 3/1982 | Okazaki et al. | 560/55 |
| 4,407,848 | 10/1983 | Yamaguchi | 427/36 |
| 4,557,730 | 12/1985 | Bennett et al. | 8/922 |
| 4,559,150 | 12/1985 | Becker et al. | 252/8.6 |
| 4,783,142 | 11/1988 | Mutzhas | 350/311 |
| 4,847,071 | 7/1989 | Bissett et al. | 252/107 |
| 4,861,651 | 8/1989 | Goldenhersh | 427/160 |
| 4,869,897 | 9/1989 | Chatterjec et al. | 252/108 |
| 4,946,671 | 8/1990 | Bissett et al. | 252/107 |
| 4,954,332 | 9/1990 | Bissett et al. | 252/107 |
| 5,000,945 | 3/1991 | Kobayashi et al. | 424/59 |
| 5,034,213 | 7/1991 | Rosenbaum et al. | 8/405 |

*Primary Examiner*—Paul Lieberman
*Assistant Examiner*—Margaret Einsmann
*Attorney, Agent, or Firm*—Rhodes, Coats & Bennett

[57] ABSTRACT

A process for preparing a dyed fabric material having an increased lightfastness of at least 600 hours. The process includes the steps of immersing the dyed fabric in an aqueous solution of a cinnamate ester, removing the fabric from solution and drying the fabric.

2 Claims, No Drawings

PROCESS FOR INCREASING THE LIGHTFASTNESS OF DYED FABRICS

BACKGROUND OF THE INVENTION (1) Field of the Invention

The present process relates generally to treated fabrics having a substantially increased degree of lightfastness as compared with untreated fabrics and, more particularly, to a method of improving the lightfastness of dyed Cordura fabric by treating the fabric with an aqueous solution containing a cinnamate ester.

(2) Description of the Prior Art

The automotive industry requires an upholstery material which can resist decoloration over time. Normally, fabric is dyed with an appropriate dye and then treated with a chemical treating agent to improve the lightfastness of the upholstery material. However, with the need for higher and higher quality products, the automotive industry is demanding improved upholstery materials. Thus, there is a need for a process which produces an upholstery material having a substantial increase in lightfastness.

Lightfastness refers to the resistance of a material to change in its color characteristics as a result of exposure to sunlight or an artificial light source. It is a special case (a subset) of the broader concept of colorfastness. Colorfastness refers to the resistance of a material to change in its color characteristics, to transfer of its colorants to adjacent materials, or both, as a result of exposure to any real or simulated environment encountered during processing, storage, use or testing of the material.

U.S. Pat. No. 5,000,945 (Kobayashi et al) relates to the use of para-methoxy cinnamic acid compounds as UV absorbers. The compounds can be incorporated into fibers, paints and resins. The patent does not disclose the use of cinnamate ester compounds as modifiers for improving the lightfastness of Cordura TM (nylon) fabrics.

U.S. Pat. No. 4,783,142 (Mutzhas) relates to the use of cinnamic acid compounds as UV absorbers. The compounds can be incorporated in coatings for shades, awnings, tents and the like. The patent does not disclose the use of cinnamate ester solutions to improve the lightfastness of Cordura TM fabrics.

All of the above patents are incorporated herein by reference in their entirety.

Fabrics useful as upholstery material in the automotive industry are Cordura TM (nylon) fabric and polyester fabric. The Cordura fabric is preferred because it is more durable and can be more easily installed. The Cordura fabric is dyed with an acid dye or a pre-metallized acid dye. The polyester fabric is dyed with a disperse dye.

Typical acid dyed fabrics have a lightfastness according to the AATCC standard testing methods of about 60 to 80 hours. Fabrics dyed with pre-metallized acid dyes (metal complexes) have increased lightfastness, but even these fabrics show appreciable loss of color after about 150 to 200 hours of testing. Color loss in the fabrics is due primarily to harmful effects of ultraviolet (UV) radiation. Although the limits of the spectral range of UV radiation are not well defined, the following range is commonly accepted:

UV-A 315 to 400 nm.

UV-B 280 to 315 nm.

UV-C 200 to 280 nm.

The radiation falling within the range 315 to 400 nm (nanometers) appears to be the most harmful to the lightfastness of dyed fabrics.

Acid dyes are a class of water-soluble anionic dyes whose original members all had one or more sulfonic or carboxylic acid groups. Examples of acid dyes are azo compounds, anthraquinones, triarylmethanes, azines, xanthenes, ketone imines, nitro compounds, nitroso compounds and quinolines. These acid dyes can be applied to such materials as nylon, wool, silk, modified acrylics and leather.

Specific examples of acid dyes are CI Acid Green I (nitroso), CI Disperse Yellow 42 (Nitro), CI Acid Blue 116 (disazo), CI Direct Black 78 (trisazo), CI Acid Brown 120 (polyazo), CI Acid Green 3 (triarylmethane), CI Acid Yellow 5 (quinoline), CI Acid Blue 121 (azine), CI Acid Yellow 73 (xanthene), CI Disperse Red (azo), CI Blue I (indigoid), CI Direct Blue 986 (phthalocyanine).

Dyes which have been metallized by the dye manufacturer prior to use by the dyer are called "premetallized dyes". Two types of premetallized dyes are the 1:1 complexes and the 2:1 complexes. The ratios refer to the number of ligand-to-metal bonds in the complex. Premetallized dyes most commonly refer to metal complexes of certain o,o'-dihydroxyazo,o-carboxy-o'-hydroxazo,o-amino-o-hydroxazo, acrylazosalicylic acid and formazan compounds.

The premetallized dyes are used to dye substrates such as wool and nylon. Examples of premetallized acid dyes are acid Black 52 (monoazo), Acid Black 63 (monoazo), Irgalan Brown Violet DL (bis-azo, 2:1 chromium complex), Neolan Blue 2G (monazo, 1:1 chromium complex), Neolan Yellow GR (mono-azo, 1:1 chromium complex), Irgalan Brown Violet DL (bis-azo: 2:1 chromium complex), and CI Acid Black 180 (formazan-type, 2:1 cobalt complex).

Thus, there remains a need for a new and improved upholstery materials produced by a process which produces an upholstery material having a substantial increase in lightfastness over conventional dyes and treatments. It has been discovered that the harmful effects of UV radiation, especially UV-A radiation, on the lightfastness of dyed fabrics can be substantially reduced by the present invention.

SUMMARY OF THE INVENTION

The process according to the present invention comprises preparing a dyed fabric having increased lightfastness in a photon-rich environment by obtaining a dyed fabric, immersing the fabric in an aqueous solution comprising a cinnamate ester, removing the fabric from solution, padding the wet fabric and drying the fabric.

The present process is not limited to nylon and polyester fabrics, but can be employed with such materials as wool, cotton and other synthetic and natural materials. The fabrics can be woven or nonwoven. The fabric materials are dyed in any conventional manner to obtain a colored product which is stable to normal washing and cleaning operations. The dye compositions are selected from the class of dye materials comprising acid dyes, pre-metallized acid dyes and fibre reactive dyes.

In a preferred embodiment, the fabric is selected from the group consisting of nylon, polyester, cotton and wool.

The present invention also relates to a dyed fabric material having increased lightfastness which is prepared according to the process as disclosed above.

These and other aspects of the present invention will become apparent to those skilled in the art after a reading of the following description of the preferred embodiment.

DESCRIPTION OF THE PREFERRED EMBODIMENTS

The present invention is an improvement in a process for increasing the lightfastness of a textile material comprising obtaining a dyed textile material, immersing the dyed material in an aqueous solution or dispersion comprising a chemical treating agent for increasing lightfastness, removing the treated textile material from solution or dispersion, padding the treated material and drying the material. The improvement comprises employing as the chemical treating agent a cinnamic acid ester.

Preferably, the fabric is a member selected from the group consisting of a pre-metallized acid dyed fabric, an acid dyed fabric and a fibre reactive dyed fabric. The dyed fabric is immersed in the aqueous solution at ambient temperature. After removal from the aqueous solution, the fabric is padded and then dried at a temperature of about 100° C. to 180° C., preferably about 160° C.

The aqueous solution which comprises about 0.01 to 10 wt. % cinnamate ester, is usually prepared from a concentrate containing at least one surfactant and at least one ester. Other UV absorbing materials can also be present, along with other adjuvants and additives. It is also conceivable to add dye ingredients to the concentrate. Additives include, but are not limited to, bactericides, fungicides, soil release agents, various stabilizers, fire retardants and the like.

The concentrate, which includes at least one surfactant, at least one cinnamate ester and, optionally various other ingredients, is added directly to a major amount of water to obtain an aqueous solution or dispersion comprising at least one ester. In a preferred embodiment, the water is present in an amount of about 90 wt. % to 97 wt. %.

In an alternative embodiment, the concentrate can be added directly to a dye bath, allowing the operator to perform the dyeing operation and the process for increasing lightfastness in a single step. The operator would be one skilled in the art who could adjust the various parameters of time, temperature, pressure and the like to obtain a fabric or textile material having the desired properties.

Referring now to the cinnamate ester, which is the UV absorber employed in the present process, it has been discovered that esters of cinnamic acid which have a $\lambda_{MAX}$ in the range of about 300 nm. to 400 nm, preferably about 310 nm. to 340 nm., provide excellent lightfastness when contacted with fabrics and textile materials such as, but not limited to , nylon, polyester, cotton and wool. The $\lambda_{MAX}$ refers to the wavelength of maximum energy absorbed by the particular ester of cinnamic acid. It is directly proportional to the height of the absorption peak representing maximum electromagnetic absorption. The log of the extinction coefficient (log E) is another term for $\lambda_{MAX}$.

The UV absorption peak is caused by promotion of an electron in one orbital (usually a ground-state orbital) to a higher orbital. Various chromophores cause absorption in the same general area. For example, chromophores in the visible or UV region are C=O, N=N, Ph and NO2. Examples of chromophores in the far UV region are C=C, C=C, Cl and OH. An auxochrome is a group which displaces and usually intensifies the absorption of a chromophore in a specific molecule. Groups usually regard as auxochromes are Cl, OH and $NH_2$. Realistically, auxochromes are themselves chromophores. (March, Jerry, *Advanced Organic Chemistry* (*Reactions, Mechanisms, and Structures*), 4th edition, John Willey & Sons, New York, N.Y., 1992 pp. 231–235.

The cinnamic acid esters of the present process can be defined schematically by a conjugated chromophoric construct represented by the formula:

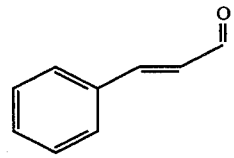

which is a spatial arrangement of the chromophores C=C, Ph(phenyl) and C=O. More specifically, the cinnamate esters can be graphically represented by the conjugated chromophoric construct having the formula:

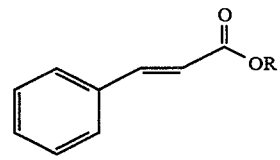

which is an arrangement of functional groups C=C, Ph(phenyl), C=O, and OR, wherein R is a member selected from the group consisting of alkyl, alkenyl, alkynyl, and alkyloxy.

In a most preferred embodiment, the esters of cinnamic acid can be graphically represented by the conjugated chromophoric construct having the formula:

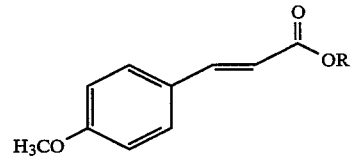

which is a particular spatial arrangement of the chromophores C=C, Ph(phenyl), C=O, $OCH_3$ and R, wherein R is as defined above. The esters all have a strong UV absorbance in the UV-A region (about 315 to 400 nm).

By "chromophoric construct" is meant a particular spatial arrangement of operatively connected functional chromophoric groups. The construct is not, nor is intended to be, a structural formula representing a compound or class of compounds. It therefore can include cinnamate esters having a variety of substituents and/or auxochromes. Substituents can be bonded directly to the aromatic ring or to the $\alpha,\beta$-unsaturated carboxylic acid moiety which is bonded to the aromatic ring. The only limitation on types and numbers of substituents is that the compound has a $\lambda_{MAX}$ of about 300–400 nm, preferably about 310 nm, to 340 nm.

In a preferred embodiment, the cinnamate ester comprises a p-methoxy cinnamate ester. In a most preferred embodiment the cinnamic acid ester is selected from the group consisting of 2-ethoxy-p-methoxycinnamate, 2-ethylhexyl-p-methoxy-cinnamate, octyl-p-methoxycinnamate and diethanolamine-p-methoxy-cinnamate. These esters are commercially available from various chemical corporations, and can be identified by tradenames such as Givsorb UV-23, Escalol 557 and Neo Helipan Type AV.

Givsorb UV-23 is a product of the Givaudan Rouro Corp. of Clifton, N.J. The chemical name is 2-propenoic acid, 3-(4-methoxy phenyl)-2-ethoxyethyl ester or 2ethoxyethyl para-methoxycinnamate. It possesses a strong UV absorption ($\lambda_{MAX}$) at 312 nanometers.

Escalol 557 is a product of the Van Dyk Corporation of Belleville, N.J. The chemical name is 2-ethylhexyl-para-methoxycinnamate.

Neo Heliopan Type AV is a product sold by the Haarmann and Reimer Corporation of Springfield, N.J. The chemical name is octyl methoxy cinnamate.

Test methods for determination of colorfastness to light of textile materials are of various kinds. The ASTM (American Society for Testing and Materials, 1916 Race Street, Philadelphia, Pa. 19103) discloses the following methods, without regard to preference:

(1) 16A-Carbon Arc Lamp, Continuous Light;
(2) 16-C-Daylight;
(3) 16D-Carbon Arc Lamp, Alternate Light and Darkness;
(4) 16E-Water-Cooled Xenon-Arc Lamp, Continuous Light;
(5) 16F-Water-Cooled Xenon Arc Lamp, Alternate Light and Darkness;
(6) 16G-Colorfastness to Light Determination of Fastness above L-7.

Although any one of the above methods can be applied as a testing procedure in the present process, the preferred test method is 16E, listed as (4) above. This method was originally developed in 1964 by AATCC Committee RA50, and has undergone many revisions since original inception.

Apparatus necessary for conducting the 16E test method include a light source which is a long-arc water-cooled Xenon-arc lamp. Different size lamps with different wattage ranges are employed depending upon type of system. In all systems, however, diameter of the specimen rack, site of the lamps and wattage of the lamps are varied so that when exposed in standard holders, irradiance at the face of the specimen is 1.10±0.03 W/m2/nm. It 420 nm.

The xenon-arc lamp itself comprises a xenon burner tube, inner pyre filter glass, outer clear (soda lime) filter glass and necessary hardware. Preferred inner filter glass is morning 7740; and preferred outer filter glass is Kibbled R6. The lamp is periodically adjusted to maintain a 20 AATCC fading unit rate in 20±5 hours of operation.

The xenon-arc exposure apparatus can be equipped with a light measuring and control system. The system allows for results of exposures to be directly computed in AATCC fading units, because it controls exposures in total light dosage units of $KJ/m^2/nm$ at 420 nm.

Light measuring and control systems comprise a quartz rod with a stainless steel covering. The rod transmits light outside a test chamber and through a narrow bandpass filter to a sensor. The sensor produces an electrical signal which is transmitted to a suitable solid state unit. From the solid state unit a direct readout can be obtained in $KJ/m^2/nm$. It 420 nm. A marketer of suitable light measuring and control system is Atlas Electric Devices Co., 4114 N. Ravens wood Ave., Chicago, Ill., 60613.

The procedure for conducting the AATCC test method 16E is as follows. A sample is cut to a size of about 7×12 cm. And mounted in an appropriate holder which preferably contains a backing of white cardboard. Front and back covers of the holder should make good contact with the sample, except over the exposure area. The filled holder is placed on a rack of the apparatus, with the holder secured in proper vertical alignment. The sample rack must be completely filled with holders containing white cardboard in all spaces not filled with a sample. The apparatus is then started and the test is conducted in a continuous fashion, with the lamp providing 20 AATCC fading units of exposure in 20±5 clock hours. Controls on the apparatus are periodically adjusted to maintain a black panel temperature of 63±10° C., a dry bulb temperature of 43±20° C., and a relative humidity of 30±5%.

After exposure, the sample from a textile material can be removed from the apparatus, but must remain in the dark at room temperature for at least 2 hours to regain moisture from the air and to cool down. Preferably, the sample is maintained at conditions of 65±2% relative humidity and 21±10° C. for a period of 4 hours.

EXAMPLE 1

An aqueous solution of Sanduvox VSU liquid was prepared in the following manner. Sanduvox VSU is an anionic liquid composition comprising sodium naphthalene sulfonate-formaldehyde copolymer (2.5–3 wt. %) and N-(2-ethoxyphenyl)-N-(2-ethylphenyl)-ethanediamide with a suitable surfactant. This liquid composition was added to water with stirring to obtain a 5.0 wt. % solution of Sanduvox VSU in water.

EXAMPLE 2

An aqueous solution of Cibafast N-2 was prepared in the following manner. Cibafast N-2 is an organo-copper complex sold by Ciba-Geigy. The complex was added to water with stirring to obtain a 3.0 wt. % solution of Cibafast N-2 in water.

EXAMPLE 3

An aqueous solution of Nicca E 3199 UV absorber was prepared in the following manner. Nicca E 3199 is a mixture of a weakly cationic polycyclic ester and a suitable surfactant. The mixture was added to water with stirring to obtain a 5.0 wt. % solution of Nicca E 3199 in water.

EXAMPLE 4

An aqueous solution of Givsorb UV-23 was prepared in the following manner. A mixture of two nonionic emulsifiers and Givsorb UV-23 was prepared. The mixture was a white milky emulsion. Givsorb UV-23 is 2-ethoxyethyl p-methoxycinnamate. A first emulsifier is a castor oil poly(ethylene oxide) nonionic surfactant. A second emulsifier is a nonylphenol poly(ethylene oxide) nonionic surfactant. The mixture of emulsifiers and cinnamate ester was then added to water with stirring to obtain a 5.0 wt. % solution of Givsorb UV-23 in water.

EXAMPLE 5

An aqueous solution of Sanduvox VSU and Givsorb UV23 was prepared in the following manner. A mixture of two nonionic emulsifiers, Givsorb UV-23 and Sanduvox was prepared. The two emulsifiers were the same as in Example 4. The mixture was then added to water with stirring to obtain a 5.2 wt. % solution of Sanduvox VSU and Givsorb UV-23 in water. The final solution contained 5.0% Sanduvox and 0.2 wt. % Givsorb.

EXAMPLE 6

An aqueous solution of Cibafast N-2 and Givsorb UV23 was prepared in the following manner. A mixture of two nonionic surfactants, Givsorb UV-23 and Cibafast N-2 was prepared. The two surfactants were the same as in Example 4. The mixture was then added to water with stirring to obtain a 3.2 wt. % solution of Cibafast N-2 and Givsorb UV-23 in water. The final solution contained 3.0 wt. % Cibafast and 0.2 wt. % Givsorb.

EXAMPLE 7

An aqueous solution of Nicca E 3199 and p-aminobenzoic acid (PABA) was prepared in the following manner. A mixture of suitable emulsifier, Nicca E 3199 and PABA was prepared. The mixture was then added to water with stirring to obtain a 5.1 wt. % solution of Nicca E 3199 and PABA in water. The final solution contained 5.0 wt. % Nicca and 0.1 wt. % PABA.

EXAMPLE 8

An aqueous solution of Ethfac 161 and Givsorb UV-23 was prepared in the following manner. A mixture of 10 grams of Givsorb UV-23 and 20 grams water as prepared. Ethfac 161 is an aliphatic phosphate ester emulsifier sold by Ethox Corporation. The mixture was then added to water with stirring to obtain a 5.0 wt. % solution of Ethfac 161 and Givsorb UV-23 in water.

EXAMPLE 9

An aqueous solution of Ethfac 161 and Givsorb UV-23 was prepared as in Example 8. The final product was an 8.0 wt. % solution of Ethfac 161 and Givsorb UV-23 in water.

EXAMPLE 10

An aqueous solution of Ethfac 161 and Givsorb UV-23 was prepared as in Example 8. To this solution was added Nicca E-3199 with stirring to obtain a 12 wt. % solution of Ethfac 161, Givsorb UV-23 and Nicca E-3199 in water. The final solution contained 8 wt. % of the solution of Example 8 and 4 wt. % Nicca E-3199.

EXAMPLE 11

An aqueous solution of PABA was prepared by mixing PABA and water to obtain 0.4 wt. % acid.

EXAMPLE 12

A Cordura TM fabric material previously dyed with a pre-metallized acid dye (charcoal gray) was cut into a sample size weighing 7.9 grams. The pre-metallized acid dye was a mixture comprising Irgalan Yellow 3RL, Irgalan Black RBL and Irgalan Bordeaux EL. The sample was then immersed in a solution of Sanduvox VSU prepared according to Example 1. The sample was removed from the solution and padded with a squeeze roller to give 118% wet pick-up. The padded sample weighed 17.2 grams. The sample was then dried in a conventional manner.

The dried sample was removed to a sample holder and placed in a sample rack contained in a Xenon-arc lamp apparatus designed for measuring colorfastness. The sample passed 350 hours of color-fastness.

EXAMPLE 13

A Cordura TM fabric material previously dyed with a pre-metallized acid dye (charcoal gray) was cut into a sample size weighing 7.5 grams. The sample was then immersed in a solution of Cibafast N-2 prepared according to Example 2. The sample was removed from the solution and padded with a squeeze roller to give 120% wet pick-up. The padded sample weighed 16.5 grams. The sample was then dried in a conventional manner.

The dried sample was removed to a sample holder and placed in a sample rack contained in a Xenon-arc lamp apparatus designed for measuring colorfastness. The sample passed 350 hours of colorfastness.

EXAMPLE 14

A Cordura TM fabric material previously dyed with a pre-metallized acid dye (charcoal gray) was cut into a sample size weighing 7.8 grams. The sample was then immersed in a solution of Nicca E-3199 prepared according to Example 3. The sample was removed from the solution and padded with a squeeze roller to give 117% wet pick-up. The padded sample weighed 16.9 grams. The sample was then dried in a conventional manner.

The dried sample was removed to a sample holder and placed in a sample rack contained in a Xenon-arc lamp apparatus designed for measuring colorfastness. The sample passed 350 hours of colorfastness.

EXAMPLE 15

A Cordura TM fabric material previously dyed with a pre-metallized acid dye (charcoal gray) was cut into a sample size weighing 7.7 grams. The sample was then immersed in a solution of Givsorb UV-23 prepared according to Example 4. The sample was removed from the solution and padded with a squeeze roller to give 108% wet pick-up. The padded sample weighed 16.0 grams. The sample was then dried in a conventional manner.

The dried sample was removed to a sample holder and placed in a sample rack contained in a Xenon-arc lamp apparatus designed for measuring colorfastness. The sample passed >600 hours of color-fastness.

EXAMPLE 16

A Cordura TM fabric material previously dyed with a pre-metallized acid dye (charcoal gray) was cut into a sample size weighing 7.6 grams. The sample was then immersed in a solution of Sanduvox VSU and Givsorb UV-23 prepared according to Example 5. The sample was removed from the solution and padded with a squeeze roller to give 104% wet pick-up. The padded sample weighed 15.5 grams. The sample was then dried in a conventional manner.

The dried sample was removed to a sample holder and placed in a sample rack contained in a Xenon-arc lamp apparatus designed for measuring colorfastness. The sample passed >600 hours of color-fastness.

EXAMPLE 17

A Cordura TM fabric material previously dyed with a pre-metallized acid dye (charcoal gray) was cut into a sample size weighing 7.8 grams. The sample was then immersed in a solution of Cibafast N-2 and Givsorb UV-23 prepared according to Example 6. The sample was removed from the solution and padded with a squeeze roller to give 104% wet pick-up. The padded sample weighed 15.9 grams. The sample was then dried in a conventional manner.

The dried sample was removed to a sample holder and placed in a sample rack contained in a Xenon-arc lamp apparatus designed for measuring colorfastness. The sample passed >600 hours of colorfastness.

EXAMPLE 18

A Cordura TM fabric material previously dyed with a pre-metallized acid dye (charcoal gray) was cut into a sample size weighing 7.1 grams. The sample was then immersed in a solution of Nicca E-3199 and PABA prepared according to Example 7. The sample was removed from the solution and padded with a squeeze roller to give 114% wet pick-up. The padded sample weighed 15.2 grams. The sample was then dried in a conventional manner.

The dried sample was removed to a sample holder and placed in a sample rack contained in a Xenon-arc lamp apparatus designed for measuring colorfastness. The sample passed >600 hours of colorfastness.

EXAMPLE 19

A Cordura TM fabric material previously dyed with a pre-metallized acid dye (charcoal gray) was cut into a sample size weighing 7.0 grams. The sample was then immersed in a solution of Ethfac 161 and Givsorb UV-23 prepared according to Example 8. The sample was removed from the solution and padded with a squeeze roller to give 121% wet pick-up. The padded sample weighed 15.5 grams. The sample was then dried in a conventional manner.

The dried sample was removed to a sample holder and placed in a sample rack contained in a Xenon-arc lamp apparatus designed for measuring colorfastness. The sample passed >600 hours of colorfastness.

EXAMPLE 20

A Cordura TM fabric material previously dyed with a pre-metallized acid dye (charcoal gray) was cut into a sample size weighing 7.4 grams. The sample was then immersed in a solution of Ethfac 161 and Givsorb UV-23 prepared according to Example 9. The sample was removed from the solution and padded with a squeeze roller to give 118% wet pick-up. The padded sample weighed 16.1 grams. The sample was then dried in a conventional manner.

The dried sample was removed to a sample holder and placed in a sample rack contained in a Xenon-arc lamp apparatus designed for measuring colorfastness. The sample passed >600 hours of colorfastness.

EXAMPLE 21

A Cordura TM fabric material previously dyed with a pre-metallized acid dye (charcoal gray) was cut into a sample size weighing 7.1 grams. The sample was then immersed in a solution of Ethfac 161, Givsorb UV-23 and Nicca E-3199 prepared according to Example 10. The sample was removed from the solution and padded with a squeeze roller to give 120% wet pick-up. The padded sample weighed 15.4 grams. The sample was then dried in a conventional manner.

The dried sample was removed to a sample holder and placed in a sample rack contained in a Xenon-arc lamp apparatus designed for measuring colorfastness. The sample passed 260 hours of colorfastness.

EXAMPLE 22

A Cordura TM fabric material previously dyed with a pre-metallized acid dye (charcoal gray) was cut into a sample size weighing 7.6 grams. The sample was then immersed in a solution of PABA prepared according to Example 11. The sample was removed from the solution and padded with a squeeze roller to give 117% wet pick-up. The padded sample weighed 16.5 grams. The sample was then dried in a conventional manner.

The dried sample was removed to a sample holder and placed in a sample rack contained in a Xenon-arc lamp apparatus designed for measuring colorfastness. The sample passed 80 hours of colorfastness.

EXAMPLE 23

A Cordura TM fabric material previously dyed with an acid dye (black) was cut into a sample size weighing 7.8 grams. The acid dye was a mixture comprising Intralan Yellow NW, Intralan Orange RDL, Intrachrome Black WA and Neutral Cyanine Green GK. The sample was then immersed in a solution of Sanduvox VSU prepared according to Example 1. The sample was removed from the solution and padded with a squeeze roller to give 119% wet pick-up. The padded sample weighed 17.1 grams. The sample was then dried in a conventional manner.

The dried sample was removed to a sample holder and placed in a sample rack contained in a xenon-art lamp apparatus designed for measuring colorfastness. The sample passed 300–350 hours of lightfastness.

EXAMPLE 24

A Cordura TM fabric material previously dyed with the same acid dye as in Example 23 was cut into a sample size weighing 7.1 grams. The sample was then immersed in a solution of Cibafast N-2 prepared according to Example 2. The sample was removed from the solution and padded with a squeeze roller to give 123% wet pick-up. The padded sample weighed 15.8 grams. The sample was then dried in a conventional manner.

The dried sample was removed to a sample holder and placed in a sample rack contained in a xenon-art lamp apparatus designed for measuring colorfastness. The sample passed 300–350 hours of lightfastness.

EXAMPLE 25

A Cordura TM fabric material previously dyed with the same acid dye as in Example 23 was cut into a sample size weighing 7.1 grams. The sample was then immersed in a solution of PABA prepared according to Example 11. The sample was removed from the solution and padded with a squeeze roller to give 124% wet pick-up. The padded sample weighed 15.9 grams. The sample was then dried in a conventional manner.

The dried sample was removed to a sample holder and placed in a sample rack contained in a xenon-art lamp apparatus designed for measuring colorfastness. The sample passed 150 hours of light-fastness.

EXAMPLE 26

A Cordura TM fabric material previously dyed with a pre-metallized acid dye was immersed in an aqueous solution of Givsorb UV-23. The material was about 50 yards in length. After immersion, the fabric material is removed to a padding roller to squeeze dry the fabric, and then dried. After drying, the material was tested for lightfastness according to ASTM 16E (Water-Cooled Xenon-Arc Lamp). The material passed 600 hours of lightfastness.

Products prepared in accordance with the present process are useful as upholstery material for household furniture, office furniture, automobile and transportation vehicle seats and the like. Other uses in environments demanding fabrics having a high level of lightfastness are readily apparent to those skilled in the art. These uses included but are not limited to outer garments, outdoor tents, headgear, travel luggage. convertible roofs for automobiles, footwear and the like.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A composition for increasing the lightfastness of dyed fabric materials consisting essentially of 0.01 to about 10.0 wt. % cinnamic acid ester, a nonionic surfactant and water in an amount of about 90% to 97% by weight.

2. A composition according to claim 1 wherein the cinnamic acid ester is selected from the group consisting of 2-ethyoxyethyl-p-methoxycinnamate, 2-ethylhexyl-p-methoxycinnamate, octyl p-methoxy cinnamate and diethanol amine-p-methoxy-cinnamate.

* * * * *